US008870479B2

(12) United States Patent
Hayashi

(10) Patent No.: US 8,870,479 B2
(45) Date of Patent: Oct. 28, 2014

(54) PRINTER

(75) Inventor: Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 13/416,376

(22) Filed: Mar. 9, 2012

(65) Prior Publication Data

US 2012/0230749 A1 Sep. 13, 2012

(30) Foreign Application Priority Data

Mar. 9, 2011 (JP) ..... 2011-051333

(51) Int. Cl.
*B41J 15/16* (2006.01)
*B41J 15/00* (2006.01)
*B41J 11/42* (2006.01)

(52) U.S. Cl.
CPC . *B41J 11/42* (2013.01); *B41J 15/16* (2013.01)
USPC ..... 400/614; 400/618

(58) Field of Classification Search
CPC ..... B41J 15/16; B41J 15/00; B41J 15/046; B41J 2/2117
USPC ..... 400/611, 583, 614, 614.1, 618
See application file for complete search history.

(56) References Cited

U.S. PATENT DOCUMENTS 5,743,663 A 4/1998 Imai
6,641,314 B2 * 11/2003 Mogi ..... 400/120.01
2009/0136281 A1 * 5/2009 Fernandez et al. ..... 400/618
2009/0255971 A1 * 10/2009 Nakamaki et al. ..... 226/1

FOREIGN PATENT DOCUMENTS

JP 2004-098696 A 4/2004

* cited by examiner

*Primary Examiner* — Daniel J Colilla
*Assistant Examiner* — John M Royston
(74) *Attorney, Agent, or Firm* — Nutter McClennen & Fish LLP

(57) ABSTRACT

A printer is configured which includes, a printing head; a first transport mechanism which transports a printing medium along a transport path; a second transport mechanism which transports the printing medium along the transport path between the printing head and the first transport mechanism; a forward transport control unit which executes a forward transport control transporting the printing medium to the printing head side using the second transport mechanism while applying a load to the printing medium using the roller, and printing a coloring agent to the printing medium using the printing head; and a reverse transport control unit which executes a reverse transport control transporting the printing medium to the first transport mechanism side using the second transport mechanism while applying a load which is smaller than that in the forward transport control to the printing medium using the roller.

5 Claims, 3 Drawing Sheets

PRINTER

BACKGROUND

1. Technical Field

The present invention relates to a printer which transports a printing medium using a roller.

2. Related Art

In the related art, there is provided a technology in which a printing medium is transported in a state where the printing medium is pinched by a plurality of rollers. For example, in JP-A-2004-98698, a paper feeding roller, or a transport roller which transports the printing medium by pinching the printing medium using two rollers is disclosed.

In the related art, in a type of a printer such as an ink jet printer in which it is necessary to fix a coloring agent to a printing medium after printing the coloring agent, such as ink or the like, on the printing medium, it was difficult to perform high speed printing without generating ink transfer. That is, when it has a configuration in which the coloring agent is dried naturally, or by using a heater or the like in order to fix the coloring agent to the printing medium, it takes a predetermined time to dry the coloring agent, and there is a problem that the coloring agent is transferred to a roller if the printing medium is transported by being pinched by two rollers before a passage of the predetermined time.

SUMMARY

An advantage of some aspects of the invention is to be able to suppress the transfer of a coloring agent to a roller in a type of printer in which it is necessary to fix the coloring agent to the printing medium.

According to an aspect of the invention, there is provided a printer in which a printing head, a second transport mechanism, and a first transport mechanism are arranged from the downstream to the upstream of a transport path. In the printer, a forward transport control, in which a printing medium is transported to the printing head side by a second transport mechanism while applying a load to the printing medium using a roller, is executed when performing printing using the printing head, and a reverse transport control, in which the printing medium is transported to the first transport mechanism side by the second transport mechanism while applying a load which is smaller than the load in the forward transport control to the printing medium using the roller, is executed after performing the printing using the printing head.

That is, it takes a lot of time to complete printing in a printer in which the printing medium after the printing is transported in the direction opposite to the transport direction (forward direction), and is printed again at the time of printing, when the printer has a configuration in which the printing medium is transported to the opposite direction after waiting until the coloring agent is sufficiently fixed to the printing medium. Therefore, when the printer has a configuration in which the printing medium is transported to the opposite direction before the coloring agent is sufficiently fixed to the printing medium in order to perform the printing at a high speed, there is a problem in that a transfer of the coloring agent occurs in the roller. However, in the invention, when executing the reverse transport control in which the printing medium is transported to the direction opposite to the transport direction at the time of printing, the printing medium is transported in a state where a load smaller than a load which is applied when executing the forward transport control at the time of printing is applied to the printing medium by the roller. Accordingly, it is possible to suppress the transfer of the coloring agent with respect to the roller.

Here, the first transport mechanism may be a mechanism which can transport the printing medium along the transport path, and may be configured by a mechanism in which the printing medium is transported by causing a roller to rotate in a state where a frictional force is applied by making the front surface of the roller and printing medium contact each other, a mechanism in which the printing medium is transported, by sending out the printing medium, or by winding the printing medium which is wound on a rotating shaft, or the like.

In addition, the second transport mechanism may be configured by a transport mechanism in which the printing medium is transported by causing the roller to rotate in a state where the frictional force is applied by making the front surface of the roller and the printing surface of the printing medium contact each other. The number of rollers may be one or more, and may be configured to be able to transport the printing medium while applying a load to the printing medium at least from the roller. A variety of configurations may be adopted as the configuration in which the load is applied to the printing medium from the roller, and for example, a configuration in which the distance between the rotating shaft of the roller and the transport path are adjusted by an actuator, or the like, may be adopted.

A forward transport control unit may be a unit which is able to transport the printing medium in the forward direction along the transport direction when performing the printing to the printing medium. A reverse transport control unit may be a unit which is able to arrange the printing medium on the upstream of the printing head by transporting the printing medium to the opposite direction along the transport direction in order to perform reprinting after performing the printing to the printing medium. Further, when these transport controls are performed, a load which is applied to the printing medium using the roller in the reverse transport control, the load may be smaller than the load in the forward transport control, and may be zero. That is, a variety of loads may be set in the reverse transport control, as long as it is possible to suppress the transfer of the coloring agent to the roller.

Further, it is possible to adopt a configuration in which, in the forward transport control and the reverse transport control, a transport amount of the printing medium per unit time of the first transport mechanism and the second transport mechanism is controlled to be different from each other, and the printing medium is transported in a tensed state. For example, in both the forward transport control and the reverse transport control, a configuration may be adopted in which the first transport mechanism and the second transport mechanism are controlled so that the transport amount of the printing medium per unit time by the second transport mechanism is larger than the transport amount of the printing medium per unit time by the first transport mechanism. That is, it is set such that, in both the forward transport control and the reverse transport control, the second transport mechanism has a larger amount of transport of the printing medium per unit time than the first transport mechanism. In this case, it is possible to control the tension of the printing medium to be different due to the fact that each of the forward transport control and the reverse transport control has opposite transport directions to each other.

Specifically, since the printing medium is transported to the print head side through the second transport mechanism from the first transport mechanism side in the forward transport control, it is possible to perform a transport control so that the printing medium is in a tensed state between the second transport mechanism and the first transport mechanism, by configuring such that the second transport mechanism has a larger amount of transport of the printing medium per unit time than the first transport mechanism. On the other hand, in the reverse transport control, since the printing medium is transported to the first transport mechanism side from the second transport mechanism, it is possible to perform the transport control so that the printing medium is in a state of being loosen (state with no tension) between the second transport mechanism and the first transport mechanism, through configuring so that the second transport mechanism has a larger amount of transport of the printing medium per unit time than the first transport mechanism. That is, back tension, which is opposite to the forward direction, is applied with respect to the printing medium, in the forward transport control, and the back tension is not applied with respect to the printing medium, in the reverse transport control.

In this manner, in a state where the back tension is applied to the printing medium in the forward transport control, and the back tension is not applied to the printing medium in the reverse transport control, it is possible to transport the printing medium while easily maintaining a desired transport accuracy, even if, in the reverse transport control, the load applied to the printing medium by the roller is smaller than that in the forward transport control. That is, the smaller the load which is applied to the printing medium by the roller in the second transport mechanism, the larger the transport error (amount of movement of the printing medium which moves in a direction perpendicular to the transport direction, when a unit quantity of the printing medium is transported in the transport direction) of the printing medium. In addition, in a state where the back tension is applied to the printing medium, the printing medium slides easily in the transport path compared to a state where the back tension is not applied to the printing medium, accordingly, it becomes a state where transport errors easily increase.

However, according to the invention, a transport control is performed so that the load which is applied to the printing medium by the roller in the forward transport control becomes larger than that in the reverse transport control. As a result, transport errors are suppressed in a state where the back tension is applied, it is possible to prevent an excessive load from being applied by the roller in a state where the back tension is not applied, and to make a state where transport errors are suppressed.

Further, the load may be determined such that the transport error is suppressed to the desired error, or to be lower than that. For example, in both the forward transport control unit and the reverse transport control unit, a configuration may be adopted, in which the printing medium is applied with a load with which the transport error (an amount of movement of the printing medium which moves in a direction perpendicular to the transport direction, when a unit quantity of the printing medium is transported in the transport direction) becomes a predetermined reference, or lower than that. According to the configuration, it is possible to suppress the transport error to the desired error, or lower than that. In addition, it is possible to specify the load for suppressing the transport errors to the desired error or less, using a variety of configurations. It is possible to specify the load for transporting the printing medium with the desired transport errors or less by performing interpolation or extrapolation from obtained data, for example, when the transport error is measured, by applying the plurality of loads to the printing medium by the roller, and by transporting the printing medium which is applied with each of the plurality of loads. It is needless to say that the transport error varies due to the presence or absence of the back tension which is applied to the printing medium, accordingly, it is preferable to specify the load in a state where the back tension is applied, or a state where the back tension is not applied, respectively, by performing the measurement in a state where the back tension is applied, or a state where the back tension is not applied, respectively.

Further, the above described printer is realized as an invention of a method in which a load which is applied to a printing medium from a roller is made to be small in a reverse transport control compared to a forward transport control, or as an invention of a program of a transport control, as well. In addition, the above described device, program, and method may be realized as a single device, may be realized by using shared components in a device with complex functionality, or may include various aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Here, embodiments of the invention will be described according to the following order.

1. Configuration of ink jet printer:
2. Printing processing:
3. Other embodiment:

1. Configuration of Ink Jet Printer

Figure 1A:
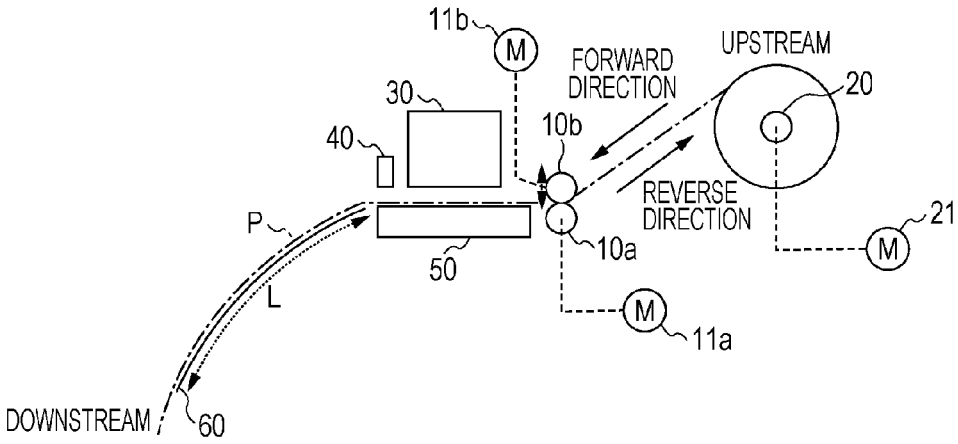
FIG. 1A is a diagram which schematically shows a configuration of an ink jet printer according to an embodiment of the invention.
Figure 1B:
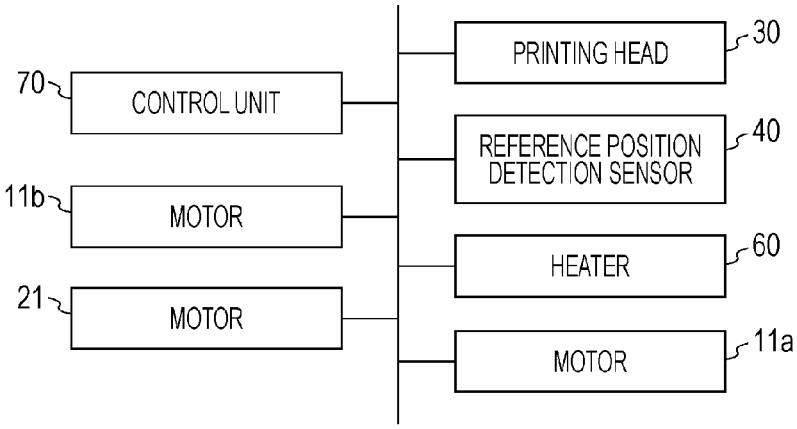
FIG. 1B is a diagram which shows a control unit included in the ink jet printer, and hardware which is controlled by the control unit.

FIG. 1A is a diagram which schematically shows a configuration of an ink jet printer according to an embodiment of the invention, and FIG. 1B is a diagram which shows a control unit included in the ink jet printer, and hardware which is controlled by the control unit. The ink jet printer according to the embodiment of the invention includes a printing head 30 which ejects ink, transports a printing medium P which is shown by one dot and dashed line in FIG. 1A on a platen 50, specifies a print start position by detecting a reference mark (+ mark or the like) on the printing medium using a reference position detection sensor 40, and performs printing by ejecting ink from the printing head 30.

In addition, in the embodiment, the printing head 30 is a head which is able to eject solvent ink of white and of a plurality of chromatic colors, performs printing of white ink on the printing medium P which is formed of a transparent film, and performs printing of chromatic color ink on a region where the white ink is printed as a printing region thereafter, thereby printing a desired image of chromatic colors on the transparent film. In the printing process, the printing medium P which is accumulated in a roller 20 to be described later is transported to the downstream side, and reaches between the printing head 30 and the platen 50, thereafter, the printing is performed while further transporting the printing medium P to the downstream of the printing head 30.

Here, since, in general, it is difficult to dry the solvent ink which is printed on the film, the ink jet printer according to the embodiment includes a heater 60 on the downstream side of the printing head 30 and the platen 50. The heater 60 is a heater which includes a heat radiation unit with a curved surface and a plate shape, and the curved surface is arranged so as to be parallel to the transport path along the transport path of the printing medium P. The curved surface of the heater 60 according to the embodiment is designed so as to have a predetermined length L along the transport path of the printing medium P, as shown in the dotted line arrow in FIG. 1. That is, the predetermined length L is designed so that the ink is dried when a printed portion of the printing medium passes through the range of the predetermined length L, in a case where the printing is continued in a state where the printing medium P on which the printing was performed by the printing head 30 is heated by the heater 60 while being transported at a predetermined transport speed. According to the embodiment, in a case where the printing medium P is transported at the predetermined transport speed while performing the printing using the printing head 30, a period which is necessary until the printing medium passes through the range of the predetermined length L at the predetermined transport speed is set as a predetermined period which is necessary to dry the ink.

In addition, according to the embodiment, once the white ink is printed on the printing medium P in the printing head 30, and the printing medium P is transported reversely in the transport path, and then the chromatic color ink is printed on the printing medium P again. For this reason, the transport mechanism of the printing medium P according to the embodiment can transport the printing medium P to the downstream side from the upstream side along the transport path, and also can transport the printing medium P to the upstream side from the downstream side along the transport path, reversely. In the specification, the direction in which the printing medium P is moved along the transport path when the printing medium P is transported from the upstream to downstream is referred to as the forward direction, and the direction in which the printing medium P is moved along the transport path when the printing medium P is transported from the downstream to upstream is referred to as the reverse direction.

A transport mechanism of the printing medium P according to the embodiment includes a transport mechanism which transports the printing medium P by pinching thereof using rollers 10*a* and 10*b*, and a transport mechanism which transports the printing medium P by accumulating the printing medium P in a shape of a roll which is wound in a roller 20, and by rotating the roller 20.

According to the embodiment, the roller 20 also serves as an accumulation unit of the printing medium P. Since the printing medium P is transported in the transport path, when the printing medium P which is accumulated in the roller 20 is sent out, the roller 20 is positioned on the most upstream of the transport path of the printing medium P. In addition, a motor 21 is connected to the roller 20, and the printing medium P which is accumulated in the shape of roll is sent out, or is wound when the motor 21 is rotated in a predetermined direction, or a direction opposite to the predetermined direction. According to the embodiment, the roller 20 and the motor 21 corresponds to a first transport mechanism which transports the printing medium P along the transport path in the most upstream of the transport path.

The rollers 10*a* and 10*b* are located on the upstream of the transport path of the printing head 30, and on the downstream of the transport path of the first transport mechanism, and are provided so that the rotating shafts of the rollers 10*a* and 10*b* are parallel. According to the embodiment, the position of the roller 10*a* is fixed, and is supported in the ink jet printer so as to rotate around the rotating shaft. In addition, a motor 11*a* is connected to the roller 10*a*, and it is possible to rotate the roller 10*a* in a predetermined direction, or in a direction opposite to the predetermined direction, due to a rotation of the motor 11*a* in a predetermined direction, or in a direction opposite to the predetermined direction.

The roller 10*b* is supported in the ink jet printer so that the rotating shaft of the roller 10*b* is able to vary the position in a state of being orientated in parallel to the rotating shaft of the roller 10*a*. That is, the roller 10*b* is configured to be movable such that the rotating shaft of the roller 10*a* and the rotating shaft of the roller 10*b* are adjacent to each other, or are separated from each other, in a state where the outer periphery of the roller 10*a* and the outer periphery of the roller 10*b* come into contact with each other. In addition, the motor 11*b* is connected to the roller 10*b*, and it is possible to make the rotating shaft of the roller 10*b* be adjacent to the rotating shaft of the roller 10*a*, or be separated therefrom, due to a rotation of the motor 11*b* in a predetermined direction, or in a direction opposite to the predetermined direction. Therefore, according to the embodiment, it is possible to adjust the load which is applied to the printing medium P from the roller 10*b* by moving the rotating shaft of the roller 10*b*.

Further, it is possible to transport the printing medium P from the upstream to the downstream of the transport path, or from the downstream to the upstream of the transport path reversely, by rotating the roller 10*a* in a predetermined direction, or in a direction opposite to the predetermined direction, in a state where the printing medium P is pinched between the rollers 10*a* and 10*b*. In this manner, according to the embodiment, the rollers 10*a* and 10*b*, and the motors 11*a* and 11*b* configure the transport mechanism, and correspond to the second transport mechanism, since the rollers 10*a* and 10*b*, and motors 11*a* and 11*b* are located between the printing head 30 and the first transport mechanism (the roller 20 and motor 21).

The ink jet printer according to the embodiment includes the heater 60 as described above, accordingly, the ink on a printed portion is dried, when a predetermined period elapses in a state where a heat is radiated to the printed printing medium P from the heater 60, after the printing is performed with respect to the printing medium P. However, as described above, when it is necessary to wait until white ink is dried, in a configuration in which the printing medium P on which the white ink is printed is reversely transported in the transport path to be printed with the chromatic color ink again, the printing medium P is necessary to be reversely transported after waiting until a predetermined period elapses from the timing at which the white ink is printed finally with respect to the printing region of the printing medium P. Accordingly, it is difficult to perform high speed printing in a configuration of waiting the white ink to be dried.

Therefore, according to the embodiment, in the reverse transport control in which the printing medium P is reversely transported, it is controlled such that the load which is applied to the printing medium P from the roller 10*b* is set to be smaller than that in the forward transport control in which the printing medium P is transported in the forward direction. That is, it is configured to be able to perform high speed printing, through configuring so that the white ink is hardly transferred, even when the printing medium P is reversely transported before a predetermined period elapses from a timing when the white ink is printed last.

That is, the ink jet printer according to the embodiment includes a control unit 70 as shown in FIG. 1B, and the printing head 30, the reference position sensor 40, the heater 60, the motors 11*a*, 11*b*, and 21 are connected to the control unit 70 through an interface which is not shown. In addition, it is possible to perform the printing in the printing head 30 while transporting the printing medium P by a control of the control unit 70 which controls each unit by outputting a control signal thereto. Therefore, in this configuration, the printing is performed by controlling the load of the roller 10*b*, and a transport timing so that the transfer of the white ink hardly occurs, even when the printing medium P is reversely transported before a predetermined period elapses from the timing when the white ink is printed last, when the control unit 70 performs the printing processing according to a flowchart shown in FIG. 2.

2. Printing Processing

Figure 2:
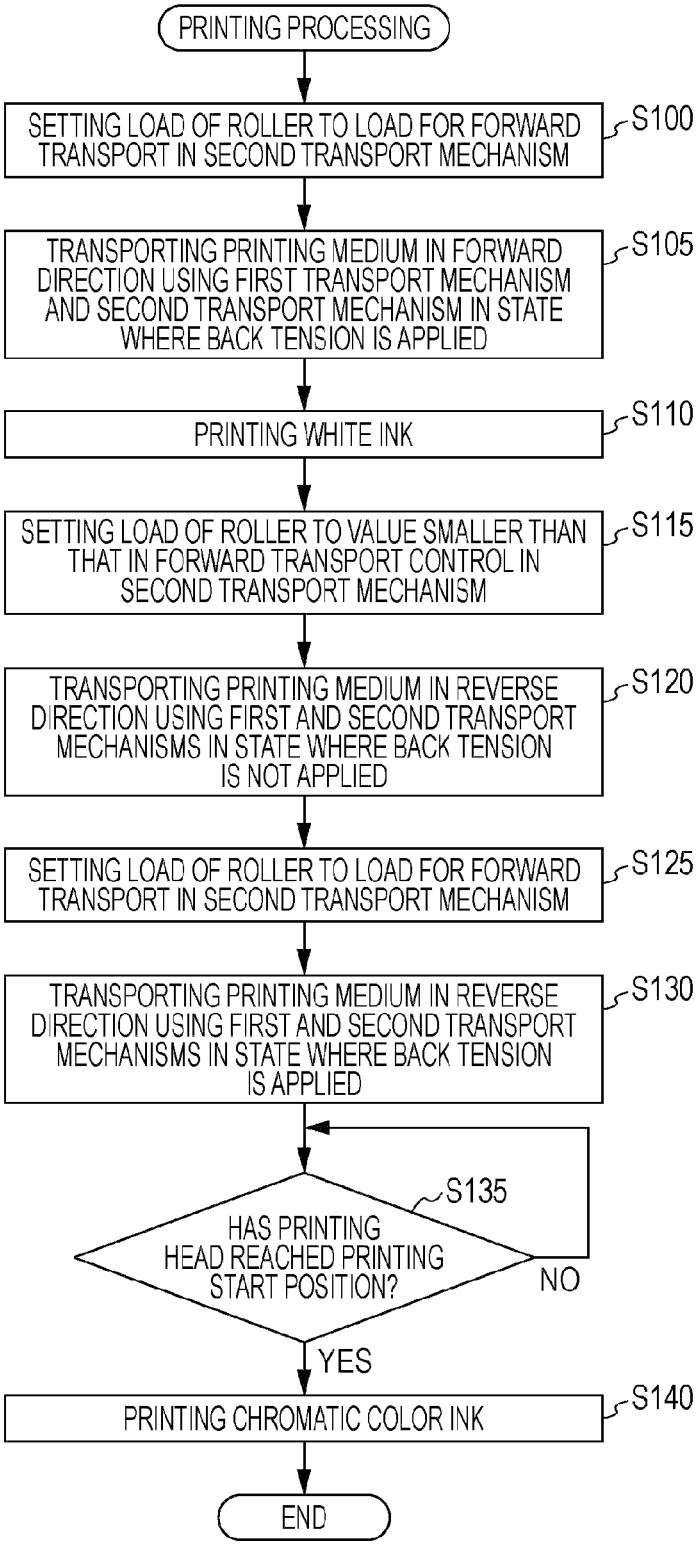
FIG. 2 is a flowchart of printing processing.

In the printing processing shown in FIG. 2, the control unit 70 sets a load of the roller 10*b* in the second transport mechanism, in a state where the printing medium P is sent out from the roller 20, and at least the leading end of the printing medium P is pinched between the rollers 10*a* and 10*b* to a load for the forward transport control (step S100). That is, the control unit 70 drives the motor 11*b* by outputting a control signal to the motor 11*b*, and drives the motor 11*b* so that the load which is predetermined as the load in the forward transport control is applied to the printing medium P from the roller 10*b*. The load is a value which is predetermined for the forward transport control, and a method of determining thereof will be described later.

Subsequently, the control unit 70 transports the printing medium P in the forward direction using the first transport mechanism and second transport mechanism, in a state where the back tension is applied to the printing medium P (step S105). That is, the control unit 70 transports the printing medium P from the upstream to the downstream, by rotatably driving the motors 11*a* and 21 in a predetermined direction by outputting a control signal to the motors 11*a* and 21, sending out the printing medium P by rotating the roller 20 in a predetermined direction, and rotating the roller 10*a* in a predetermined direction. Further, the control unit 70 controls the motors 11*a* and 21 such that the transport amount of the printing medium P per unit time by the roller 10*a* is larger than that by the roller 20. As a result, in the forward transport control, the printing medium P becomes a spread state (a state where the back tension is applied) between the rollers 20 and 10*a*.

Figure 3:
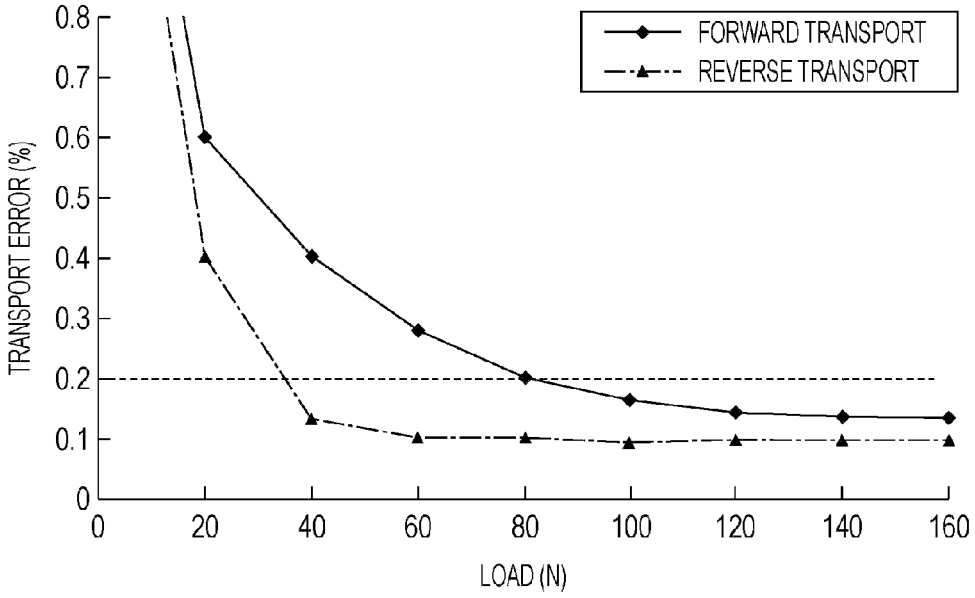
FIG. 3 is a diagram which shows a relationship between a transport error and a load.

In the above described step S100, the load which is applied to the printing medium P from the roller 10*b* is a load in which the transport error of the printing medium P (an amount of movement of the printing medium which moves in a direction perpendicular to the transport direction, and in a direction parallel to the shaft of the roller 10*a*, when a unit quantity of the printing medium is transported along the transport direction) is predetermined so as to be lower than a predetermined reference. FIG. 3 is a diagram which shows a transport error of the printing medium for every load which is applied to the printing medium P by the roller 10*b*, in which the vertical axis denotes a transport error (%), and the horizontal axis denotes the load (N). In the FIG. 3, a relationship between the transport error and the load when the forward transport is performed in a state where the back tension is applied is exemplified, using a solid line and a square marker.

In the ink jet printer according to the embodiment, it is possible to perform printing using the printing head 30 without deteriorating an image quality, when the transport error is 0.2% or less. Therefore, the control unit 70 drives the motor 11*b* so that the load is set to a load (80N or more) in which the transport error becomes 0.2% or less, in step S100. As a result, in step S105, it is possible to transport the printing medium P in a state where the load which is applied to the printing medium P from the roller 10*b* when the forward transport control is performed becomes 80N or more, and the transport error is suppressed to 0.2% or less.

Subsequently, the control unit 70 prints the white ink (step S110). That is, the control unit 70 outputs a control signal to the motors 11*a* and 21, and the printing head 30, transports the printing medium P at the same timing when the ink is ejected from the printing head 30, and causes the white ink to be ejected from the printing head 30 according to printing data which denotes an image as a printing target. That is, the white ink is printed on the printing medium P by performing the forward transport control.

In addition, when printing the white ink, the control unit 70 records a relationship between the reference position on the printing medium P and the printing start position by the printing head 30. That is, the control unit 70 drives the reference position detection sensor 40 by outputting a control signal with respect to the reference position detection sensor 40, and detects the reference position on the printing medium P on the basis of a signal which is output from the reference position detection sensor 40. In addition, the transport amount of the printing medium P which is transported by the first transport mechanism and second transport mechanism before the printing of the white ink is started is recorded in a RAM or the like (not shown), as information which denotes the printing start position.

Subsequently, the control unit 70 reversely transports the printing medium P along the transport path, and further prints the chromatic color ink again. For this reason, the control unit 70 sets the load of the roller 10*b* to a value which is smaller than that in the forward transport control in the second transport mechanism (step S115). That is, the control unit 70 drives the motor 11*b* by outputting a control signal to the motor 11*b*, and drives the motor 11*b* such that the load which is predetermined as the load in the reverse transport control, and is smaller than that in the forward transport control is applied to the printing medium P from the roller 10*b*. A method of determining the load will be described later.

Subsequently, the control unit 70 reversely transports the printing medium P using the first transport mechanism and second transport mechanism in a state where the back tension is not applied to the printing medium P (step S120). That is, the control unit 70 rotatably drives the motors 11*a* and 21 in a direction opposite to the above described predetermined direction by outputting a control signal to the motors 11*a* and 21, winds up the printing medium P by rotating the roller 20 in a direction opposite to the above described predetermined direction, and transport the printing medium P from the downstream to the upstream by rotating the roller 10*a* in a direction opposite to the above described predetermined direction. Further, the control unit 70 controls the motors 11*a* and 21 so that the transport amount of the printing medium P per unit time by the roller 10*a* becomes larger than the transport amount of the printing medium P per unit time by the roller 20. As a result, in the reverse transport control, the printing medium P becomes a non-tensed state (state where the tension is not applied) between the rollers 20 and rollers 10*a*.

The load which is applied to the printing medium P from the roller 10*b* in the above described step S115 is a load which is predetermined so that the transport error of the printing medium P is lower than the above described predetermined reference. However, since the transport error of the printing medium P varies in a state where the back tension is applied to the printing medium P, and a state where the back tension is not applied to the printing medium P, in step S115, the load is predetermined so that the transport error of the printing medium P becomes lower than the above described predetermined reference in a state where the back tension is not applied.

In FIG. 3, a relationship between the transport error and the load when the reverse transport is performed in a state where the back tension is not applied, using a one dot dashed line and a triangular marker. In the ink jet printer according to the embodiment, it is possible to perform the printing using the printing head 30 without deteriorating the image quality when the transport error is 0.2% or less. As shown in FIG. 3, if the load is 35N or more in a state where the back tension is not applied, it is possible to make the transport error be 0.2% or less. Therefore, the control unit 70 drives the motor lib so that the load is a load which can make the transport error be 0.2% or less (35N or more), and be a value which is smaller than that in the forward transport control (a value smaller than 80N, for example, 40N or the like), in step S115. As a result, in step S120, it is possible to transport the printing medium P reversely, in a state where the transport error is suppressed to 0.2% or less.

In addition, according to the embodiment, the steps S115 and S120 are executed, when the white ink is printed at a portion of the printing region of the printing medium P where the printing is performed lastly, by the step S110. Therefore, according to the embodiment, the printing medium P is reversely transported before the portion where the white ink is printed last is transported to the downstream by the length corresponding to the length L in a direction which goes along the transport direction of the heater 60. For this reason, the printing medium P is reversely transported in a state where a predetermined time has not elapsed after the printing of the white ink. However, according to the embodiment, since the load of the roller 10*b* is set so as to be smaller than that in the forward transport control in step S115, it is possible to transport the printing medium P in a state where the transfer of the white ink with respect to the roller 10*b* is suppressed, even when the white ink is not completely fixed to the printing medium P.

In step S120, when the reverse transport is performed until a printed region of the printing medium P is located on the upstream of the printing head 30, the transport of the printing medium P is stopped, the control unit 70 sets the load of the roller 10*b* in the second transport mechanism to a load for the forward transport (step S125), and transports the printing medium P using the first transport mechanism and second transport mechanism, in a state where the back tension is applied to the printing medium P (step S130). That is, the control unit 70 performs the same processing as those in steps S100 and S105. In this manner, according to the embodiment, in step S120, a predetermined amount of the printing medium P is transported to the downstream from the upstream, and then the load of the roller 10*b* is set to the load for the forward transport in step S125. However, in a combination of the printing medium P and the white ink according to the embodiment, a portion where the white ink is printed last with respect to the printing region of the printing medium P is transported to the upstream from the downstream, and is dried before the load of the roller 10*b* is set to the load for the forward transport again. Accordingly, a predetermined period substantially elapses while executing the process in step S120, and it is possible to transport the printing medium P without the transfer of the white ink occurring with respect to the roller 10*b*, even if the step S130 is executed after executing the step S125.

In step S130, when the transport of the printing medium P in the forward direction is started, the control unit 70 determines whether or not the printing head 30 reached the printing start position (step S135). That is, the control unit 70 determines that the printing head 30 has reached the printing start position, when the printing medium P is transported by the above described transport amount using the first transport mechanism and second transport mechanism, after detecting the reference position on the printing medium P on the basis of the signal which is output by the reference position detection sensor 40.

When it is not determined that the printing head 30 has reached the printing start position in step S135, the control unit 70 repeats the step S135. On the other hand, when it is determined that the printing head 30 has reached the printing start position in step S135, the control unit 70 prints the chromatic color ink (step S140). That is, the control unit 70 output the control signal to the motor 11*a* and 21, and the printing head 30, transports the printing medium P at a timing which is synchronized with the ink ejection from the printing head 30, and causes the printing head 30 to eject the chromatic color ink according to printing data which denotes an image as a printing target. In this manner, according to the embodiment, the load of the roller 10*b* is controlled so that the transport error in each of the forward transport control and the reverse transport control becomes 0.2% or less. In addition, the printing start position of the white ink and the chromatic color ink is caused to match each other by detecting the reference position using the reference position detection sensor 40. Accordingly, it is possible to prevent a deviation in the printing position between the printing of the white ink and the chromatic color ink from occurring, and to perform the printing of high image quality.

3. Other Embodiment

The above described embodiment is an example for executing the invention, and a variety of embodiments can be adopted other than that, as long as it is possible to make the load small, which is applied to the printing medium from the roller in the reverse transport control, compared to the load in the forward transport control. For example, the printer may include at least the first transport mechanism and second transport mechanism, and naturally, may include a transport mechanism other than the first transport mechanism and second transport mechanism. In addition, the printer may have a configuration in which the heater 60 is not included.

In addition, the reverse transport control in the above described step S120 may be performed in a state where the back tension is not applied to the printing medium P, and may transport the printing medium P using the second transport mechanism, by stopping the first transport mechanism.

Further, in the above described reverse transport control, it is preferable that the load which is applied to the printing medium P by the roller 10*b* be small compared to the load in the forward transport control, and it is further preferable that the load be set such that the transfer of ink is reliably prevented. For example, the load which is applied to the printing medium P by the roller 10*b* is set in plural, performs the reverse transport control, and specifies a load which does not cause the transfer of a coloring agent, in a state where the coloring agent is not fixed yet, after the printing to the printing medium P. In addition, when performing the reverse transport control, the motor 11*b* is controlled so that the load which does not cause the transfer of the coloring agent with respect to the printing medium P, and the load is applied to the printing medium P from the roller 10*b*. With this configuration, it is possible to prevent the transfer of the coloring agent to the printing medium P in the reverse transport control.

What is claimed is:

1. A printer comprising: a printing head; a first transport mechanism which transports a printing medium along a transport path;

a second transport mechanism which includes a first roller and a second roller, and transports the printing medium along the transport path between the printing head and the first transport mechanism;

a control unit which executes a forward transport control transporting the printing medium from the first transport mechanism to the printing head and a reverse transport control transporting the printing medium from the printing head to the first transport mechanism using the second transport mechanism wherein the control unit adjusts a load applied to the printing medium amount of force with which the first roller and the second roller pinch the printing medium therebetween, such that the control unit applies a first load to the printing medium by pinching the printing medium between the first roller and the second roller in the reverse transport control, the first load being smaller than a second load applied to the printing medium by pinching the printing medium between the first roller and the second roller in the forward transport control.

2. The printer according to claim 1, wherein the control unit performs the forward transport control by controlling the first transport mechanism and second transport mechanism so that a transport amount of the printing medium per unit time by the second transport mechanism becomes larger than the transport amount of the printing medium per unit time by the first transport mechanism.

3. The printer according to claim 1, wherein the control unit performs the reverse transport control by controlling the first transport mechanism and second transport mechanism so that a transport amount of the printing medium per unit time by the second transport mechanism becomes larger than the transport amount of the printing medium per unit time by the first transport mechanism.

4. The printer according to claim 1, wherein the control unit applies the first and second loads by pinching the printing medium between the first roller and the second roller such that an amount of the printing medium which moves in a direction perpendicular to the transport direction becomes a predetermined reference, or less, when a unit quantity of the printing medium is transported along the transport path.

5. The printer according to claim 1, wherein the control unit prints a coloring agent to the printing medium in the forward transport control and transports the printing medium from the printing head to the first transport mechanism in the reverse transport control before the coloring agent has dried.

* * * * *